US006783384B2

(12) United States Patent
Wu

(10) Patent No.: US 6,783,384 B2
(45) Date of Patent: Aug. 31, 2004

(54) ELECTRICAL CARD CONNECTOR WITH REINFORCING PLATE

(75) Inventor: Dong Di Wu, Shenzhen (CN)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 10/365,291

(22) Filed: Feb. 11, 2003

(65) Prior Publication Data

US 2004/0029430 A1 Feb. 12, 2004

(30) Foreign Application Priority Data

Aug. 8, 2002 (TW) ..... 91212243

(51) Int. Cl.[7] ..... H01R 13/64
(52) U.S. Cl. ..... 439/377
(58) Field of Search ..... 439/64, 377, 607

(56) References Cited

U.S. PATENT DOCUMENTS 5,286,207 A * 2/1994 McHugh ..... 439/64

6,406,304 B1 * 6/2002 Kuo ..... 439/64

* cited by examiner

*Primary Examiner*—Tho D. Ta
*Assistant Examiner*—Ann McCamey
(74) *Attorney, Agent, or Firm*—Wei Te Chung

(57) ABSTRACT

An electrical connector (1) for receiving an electrical card (2) therein. The connector includes an insulative housing (11), and a plurality of conductive terminals (18) received in the housing. The housing includes a beam (12), and a pair of parallel guiding arms (13) extending in a same direction from opposite ends of the beam respectively. A reinforcing plate (16) interconnects the guiding arms to prevent the guiding arms from bending inwardly when the connector becomes heated during use. A middle portion (162) of the reinforcing plate is offset outwardly from the housing. When the connector becomes heated during use, the reinforcing plate bends inwardly. However, space beneath the reinforcing plate is still sufficient to ensure that the reinforcing plate does not contact the received electrical card, and that the electrical card can be freely inserted into or removed from the connector.

7 Claims, 4 Drawing Sheets

ELECTRICAL CARD CONNECTOR WITH REINFORCING PLATE

BACKGROUND OF THE INVENTION

1. Field of the Invention

The present invention relates to electrical card connectors, and particularly to an electrical card connector with a reinforcing plate which ensures that an electrical card can be freely inserted into and removed from the connector.

2. Description of Prior Art

Electrical cards are widely used in computing devices for storing information. An electrical card connector is used for interconnecting the electrical card with a computing device. Details of this kind of electrical card connector can be found in "SMT Connector" (Connector Specifier, November 2000). Furthermore, examples of this kind of electrical card connector can be found in Taiwan Patent Issue Nos. 395579, 397277, 411048, 458420 and 470219. The connector comprises a pair of guiding arms for guiding an electrical card into the connector. The guiding arms are made of plastic, and a reinforcing plate interconnects the guiding arms to prevent the guiding arms from bending inwardly when the connector becomes heated during use.

FIG. 3 shows a conventional electrical card connector 9. The connector 9 comprises a beam 92, and a pair of parallel guiding arms 91 extending in a same direction from opposite ends of the beam 92 respectively. A plurality of conductive terminals 93 is received in the beam 92. One end of each terminal 93 protrudes out from an inside surface 94 of the beam 92, for connecting with an electrical card 8. An opposite end of each terminal 93 protrudes out from an opposite outside surface of the beam 92, for connecting with an electrical device. A reinforcing plate 95 interconnects the guiding arms 91, to prevent the guiding arms 91 from bending inwardly when the connector 9 becomes heated during use. The arms 91 and the reinforcing plate 95 cooperatively define a receiving space for receiving the electrical card 8 therein. When the connector 9 becomes heated during use, the reinforcing plate 95 is prone to bend downwardly, especially a middle portion of the reinforcing plate 95 (shown with broken lines in FIG. 4). The middle portion of the bent reinforcing plate 95 contacts and presses the electrical card 8. Mechanical connection between the electrical card 8 and the connector 9 may be impaired, and electrical connection between the electrical card 8 and the connector 9 may also be impaired or even lost. In addition, when the electrical card 8 is inserted into or removed from the connector 9, friction may occur between the middle portion of the bent reinforcing plate 95. The electrical card 8 may even be prevented from being inserted or removed from the connector 9.

In view of the above, a new electrical card connector that overcomes the above-mentioned disadvantages is desired. U.S. Pat. No. 6,406,304 having the same assignee with the invention, discloses an approach to cure such a problem.

SUMMARY OF THE INVENTION

Accordingly, an object of the present invention is to provide an electrical connector such as an electrical card connector for receiving an electrical card therein, whereby the electrical card can be freely inserted into and removed from the connector even when the connector becomes heated during use.

To achieve the above-mentioned object, an electrical connector in accordance with a preferred embodiment of the present invention is for receiving an electrical card therein. The connector comprises an insulative housing, and a plurality of conductive terminals received in the housing. The housing comprises a beam, and a pair of parallel guiding arms extending in a same direction from opposite ends of the beam respectively. A reinforcing plate interconnects the guiding arms to prevent the guiding arms from bending inwardly when the connector becomes heated during use. A middle portion of the reinforcing plate is offset outwardly from the housing. When the connector becomes heated during use, the reinforcing plate bends inwardly. However, space beneath the reinforcing plate is still sufficient to ensure that the reinforcing plate does not contact the received electrical card, and that the electrical card can be freely inserted into or removed from the connector.

Other objects, advantages and novel features of the invention will become more apparent from the following detailed description when taken in conjunction with the accompanying drawings, in which:

DETAILED DESCRIPTION OF PREFERRED EMBODIMENT OF THE INVENTION

Reference will now be made to the drawings to describe the present invention in detail.

Figure 1:
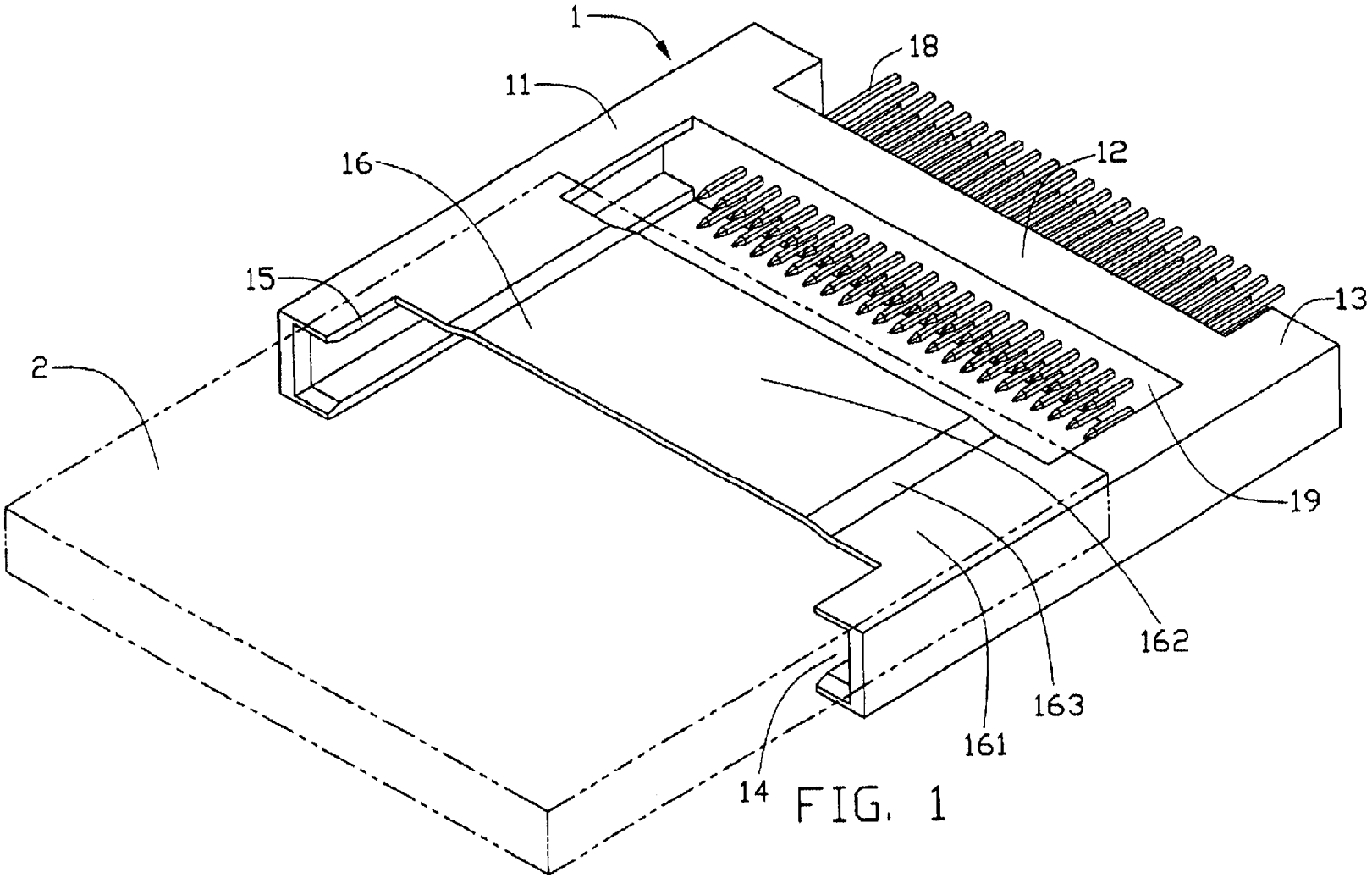
FIG. 1 is an isometric view of an electrical connector in accordance with a preferred embodiment of the present invention, showing an electrical card in dashed lines partly inserted into the connector.

Referring to FIG 1, an electrical connector 1 in accordance with a preferred embodiment of the present invention is for receiving an electrical card 2 therein. The connector 1 comprises an insulative housing 11, and a plurality of conductive terminals 18 received in the housing 11. The housing 11 comprises a beam 12, and a pair of parallel guiding arms 13 extending in a same direction from opposite ends of the beams 12 respectively, a receiving space is formed between the two guiding arms 15 for receiving the electrical card 2. The terminals 18 are received in the beam 12. One end of each terminal 18 protrudes out from an inside surface 19 of the beam 12, for connecting with the electrical connector 2. An opposite end of each terminal 18 protrudes from an opposite outside surface of the beam 12, for connecting with an electrical device. Each guiding arm 13 defines an inner guiding slot 14, for guiding the electrical card 2 into the connector 1. Each guiding slot 14 is bounded by an upper guiding wall 15. A reinforcing plate 16 interconnects the guiding walls 15 of the guiding arms 13, to prevent the guiding arms 13 from bending inwardly when the connector 1 becomes heated during use. The reinforcing plate 16 is spaced an even distance from the beam 12, and is thinner than either of the guiding walls 15. The reinforcing plate 16 comprises a middle portion 162 offset outwardly from the housing 11 and being located substantially above a middle of the receiving space, a pair of side portions 161 respectively connecting with the guiding arms 13 and extending toward each other in a substantially parallel direction away from the guiding arms 13, and a pair of slanted connecting portions 163 respectively interconnecting the side portions 161 with the middle portion 162. The reinforcing plate 16 of the present invention is a part of the insulative housing 11, which has a same plastic material as that of the beam 12 and the guiding walls 15 and is integrally molded with the beam 12 and the guiding walls 15.

Figure 2:
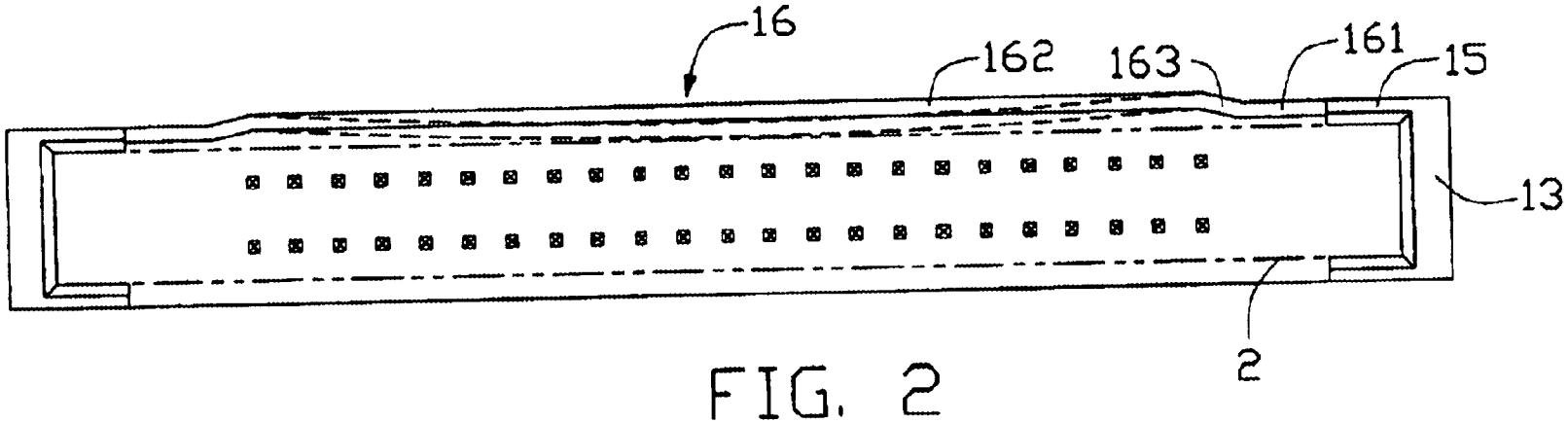
FIG. 2 is a front end elevation view of FIG. 1, showing a reinforcing plate of the connector in a normal straight position in unbroken lines, and in a bent position in broken lines.
Figure 3:
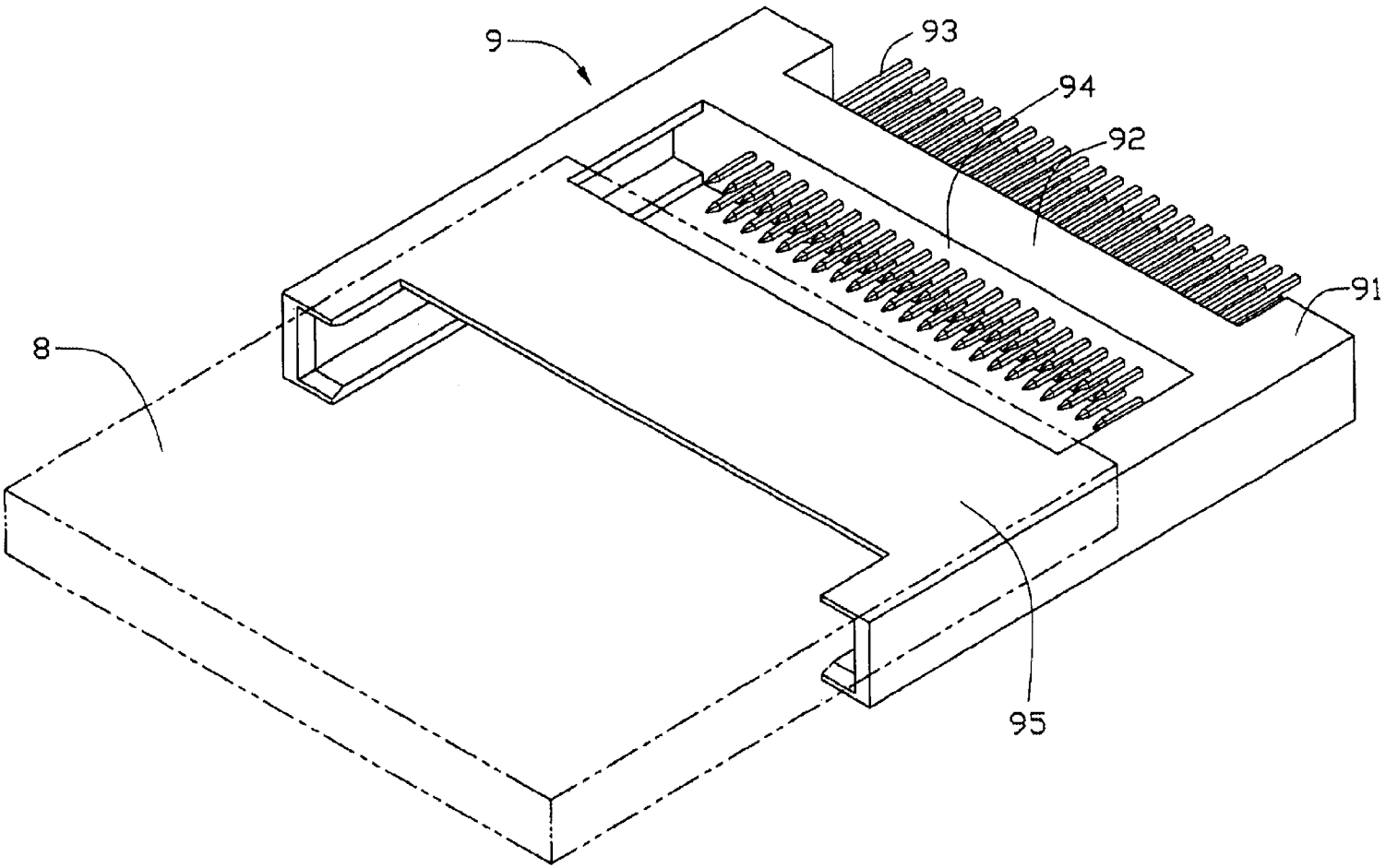
FIG. 3 (PRIOR ART)
FIG. 3 is an isometric view of a conventional electrical connector, showing an electrical card in dashed lines partly inserted into connector.
Figure 4:
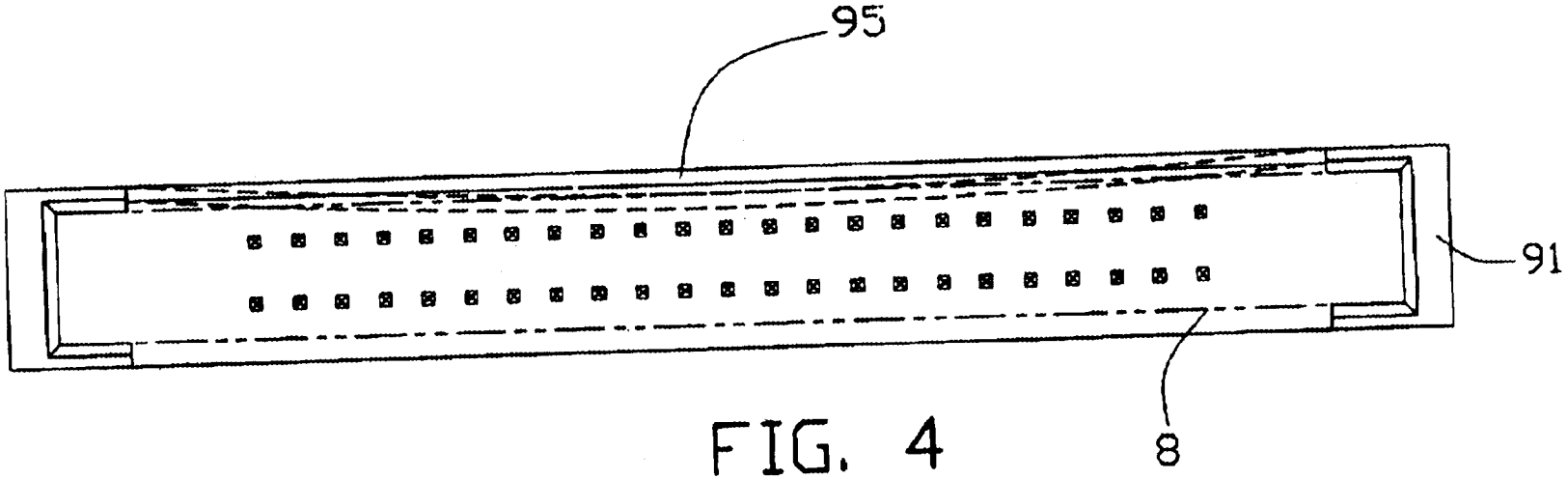
FIG. 4 (PRIOR ART)
FIG. 4 is a front end elevation view of FIG. 3, showing a reinforcing plate of the connector in a normal straight position in unbroken lines, and in a bent position in broken lines.

Referring to FIG. 2, a top of the side portion 161 and tops of the guiding walls 15 are coplanar. Because the reinforcing plate 16 is thinner than the guiding walls 15, a first distance is defined between a bottom of each side portion 161 and a bottom of the adjacent guiding wall 15. A second distance is defined between a bottom of the middle portion 162 and a bottom of either guiding wall 15. Because the middle portion 162 is offset outwardly from the housing 11, the second distance is greater than the first distance. A third distance is defined between a bottom surface of either connecting portion 163 and a bottom of either guiding wall 15. The third distance is greater than the first distance, and less than the second distance. When the connector 1 becomes heated during use, the reinforcing plate 16 bends downwardly (shown with broken lines), especially at the middle portion 162. Spaces represented by the first, second and third distances respectively and cooperatively allow the side, middle and connecting portions 161, 162, 163 of the reinforcing plate 16 to bend inwardly without contacting the electrical card 2. The reinforcing plate 16 does not press or interfere with the electrical card 2. Reliable electrical connection can be maintained between the connector 1 and the electrical card 2. In addition, the electrical card 2 can be freely inserted into or removed from the connector 1.

While a preferred embodiment in accordance with the present invention has been shown and described, equivalent modifications and changes known to persons skilled in the art according to the spirit of the present invention are considered within the scope of the present invention as defined in the appended claims.

What is claimed is:

1. An electrical connector for mounting on a circuit substrate, the electrical connector comprising:

an insulative housing comprising a beam, a pair of parallel guiding arms extending in a same direction from opposite ends of the beam to form a receiving space for accommodating a electrical card therein, and a reinforcing plate integrally interconnecting the guiding arms; and a plurality of conductive terminals received in the beam of the housing;

wherein the reinforcing plate comprises a pair of side portions respectively connecting with the guiding arms and extending toward each other in a substantially parallel direction away from the guiding arms and a middle portion offset outwardly from the side portions and being located substantially above a middle of the receiving space.

2. The electrical connector as claimed in claim 1, wherein the reinforcing plate further comprises a pair of connecting portions respectively interconnecting the side portions with the middle portion.

3. The electrical connector as claimed in claim 2, wherein each of the guiding arms defines a guiding slot, the guiding slot is bounded by a guiding wall, and the guiding wall is thicker than an adjoining respective one of the side portions of the reinforcing plate.

4. An electrical card connector for receiving an electrical card therein, the electrical card connector comprising:

an insulative housing for receiving the electrical card therein, the housing comprising a beam, a pair of parallel guiding arms extending in a same direction from opposite ends of the beam, and a reinforcing plate integrally interconnecting the guiding arms;

a receiving space formed between the pair of guiding arms and under said reinforcing plate; and a plurality of conductive terminals received in the beam of the housing;

wherein the reinforcing plate comprises a pair of side portions vertically communicatively located above the receiving space and respectively connecting with the guiding arms and extending toward each other in a substantially parallel direction away from the guiding arms and a middle portion being defined in a different plane which are offset from a plane defined by the side portions.

5. The electrical card connector as claimed in claim 4, wherein after a heat procedure, the middle portion of the reinforcing plate is curvedly downwardly deflected toward the receiving space.

6. The electrical card connector as claimed in claim 4, wherein the reinforcing plate comprises a pair of connecting portions respectively interconnecting the side portions with the middle portion.

7. The electrical card connector as claimed in claim 6, wherein each of the guiding arms comprises a guiding slot, the guiding slot is bounded by a guiding wall, and the guiding wall is thicker than an adjoining respective one of the side portions of the reinforcing plate.

* * * * *